United States Patent [19]

Abe

[11] Patent Number: 5,048,663

[45] Date of Patent: Sep. 17, 1991

[54] ELECTRONIC COIN ACCEPTOR

[75] Inventor: Hiroshi Abe, Tokyo, Japan

[73] Assignee: Asahi Seiko Kabushiki Kaisha, Tokyo, Japan

[21] Appl. No.: 407,120

[22] Filed: Sep. 14, 1989

[30] Foreign Application Priority Data

Sep. 17, 1988 [JP] Japan ..... 63-121192[U]
Sep. 17, 1988 [JP] Japan ..... 63-121193[U]

[51] Int. Cl.[5] ..... G07D 5/08
[52] U.S. Cl. ..... 194/317; 194/346
[58] Field of Search ..... 194/346, 350, 317, 318, 194/319

[56] References Cited

U.S. PATENT DOCUMENTS

| | | | |
|---|---|---|---|
| 3,907,088 | 9/1975 | Burzen | 194/346 X |
| 4,333,557 | 6/1982 | Kozak | 194/317 |
| 4,625,851 | 12/1986 | Johnson et al. | 194/317 X |
| 4,754,862 | 7/1988 | Rawicz-Szczerbo et al. | 194/317 X |
| 4,883,158 | 11/1989 | Kobayashi et al. | 194/317 X |

FOREIGN PATENT DOCUMENTS

| | | | |
|---|---|---|---|
| 0310429 | 4/1989 | European Pat. Off. | 194/346 |
| 1925458 | 12/1970 | Fed. Rep. of Germany | 194/350 |
| 3727927 | 3/1989 | Fed. Rep. of Germany | 194/350 |

*Primary Examiner*—Robert J. Spar
*Assistant Examiner*—Scott L. Lowe
*Attorney, Agent, or Firm*—Nilles & Nilles

[57] ABSTRACT

An electronic coin acceptor comprises a particular components portion mainly including a coin passage, at least one sensor and an oscillating circuit for providing information signals in response to the dimensions and material of a coin and a common components portion mainly including a coin discriminating circuit for producing a gate actuating signal, a coin acceptance chute and a gate at the inlet of the coin acceptance chute. The particular components portion is detachable from the common components portion and replaceably by a different particular components portion that is designed to discriminate a new coin that differs from the coins previously being examined by the acceptor.

8 Claims, 6 Drawing Sheets

ELECTRONIC COIN ACCEPTOR

BACKGROUND OF THE INVENTION

1. Field of the invention

The present invention relates to a coin acceptor for use in coin operated vending machines, game machines or other similar equipment and, in particular to an electronic coin acceptor adapted for discriminating a genuine coin or coins of a particular denomination from spurious coins or slugs by means of a sensor coil.

In general, such an electronic coin acceptor comprises a coin passage adapted for passing a coin having particular dimensions, at least one sensor arranged at one or both of the opposite sides of the coin passage for interacting with a coin travelling in the coin passage, an oscillating circuit connected to the sensor for providing information signals in response to the dimensions and material of the coin, a coin discriminating circuit for determining whether the information signals are indicative of an acceptable coin and providing a gate actuating signal, a coin acceptance chute, a coin rejection chute, a gate arranged at an inlet of the coin accepting chute, and an electromagnetic solenoid for actuating the gate. 2. Description of the Prior Art Hitherto, such electronic coin acceptors have been constructed to arrange the above mentioned components within a housing or outer frame so as to be adapted for a particular kind of coin to be accepted or for installation in a particular type of coin operated vending machines. Therefore, it has been required that coin acceptors of various constructions be manufactured and as a result the efficiency in manufacturing is low and the cost is high.

SUMMARY OF THE INVENTION

It is an object of the invention to provide an electronic coin acceptor arranged to be efficiently and inexpensively manufactured.

It is another object of the invention to provide a coin acceptor having a coin accepting chute adaptable for many kinds of coins of various diameters.

The electronic coin acceptor according to the present invention comprises a particular components portion or unit including a coin passage having a width and thickness for passing a coin of particular dimensions, at least one sensor arranged at one or both of opposite sides of the coin passage for interacting with a coin travelling in the coin passage, an oscillating circuit electrically connected to the sensor for providing information signals in response to the dimensions and material of the coin and a casing enclosing the particular components, and a common components portion or unit including a coin discriminating circuit for determining whether the information signals are indicative of an acceptable coin and producing a gate actuating signal, a coin acceptance chute, a coin rejection chute, a gate arranged at an inlet of the coin acceptance chute, an electromagnetic solenoid for actuating the gate and an outer frame enclosing the common components portion and having a particular components portion receiving recess. The casing for the particular components portion is detachable to the outer frame by means of engaging pins and slots.

In a preferred embodiment, the gate is extended across the whole width of the outer frame and a plurality of guide plate setting slots, spaced apart in the width direction, are provided at the outlet portion of the acceptance chute for selectively positioning an outlet guide plate.

According to the above construction of the present invention, the common components portion constituting a main body of the coin acceptor can be commonly used for all coins including a small coin such as five cent coin and a large coin such as a one dollar coin. Therefore, when a coin acceptor for sorting a new kind of coin is demanded, it is only necessary to manufacture a new particular components portion for the new coin and to attach it to the common components portion by a simple assembling for example by means of fitting the casing of the particular components portion into the particular components portion receiving recess in the outer frame of the common components portion with the engaging pins and slots interconnected. As a result a coin acceptor for a new coin can be inexpensively and quickly supplied.

Moreover, when a denomination of coin to be used in an existing coin operated vending machine, game machine or the like is changed, it is only necessary to attach a new particular components portion to the existing common components portion in place of the old particular components portion and therefore the change of denomination of coin can be quickly, easily and inexpensively achieved.

BRIEF DESCRIPTION OF THE DRAWINGS

The object and feature of the invention and further objects, features and advantages thereof will be better understood from the following description with reference to the accompanying drawings, in which.

DESCRIPTION OF THE PREFERRED EMBODIMENTS

Figure 1:
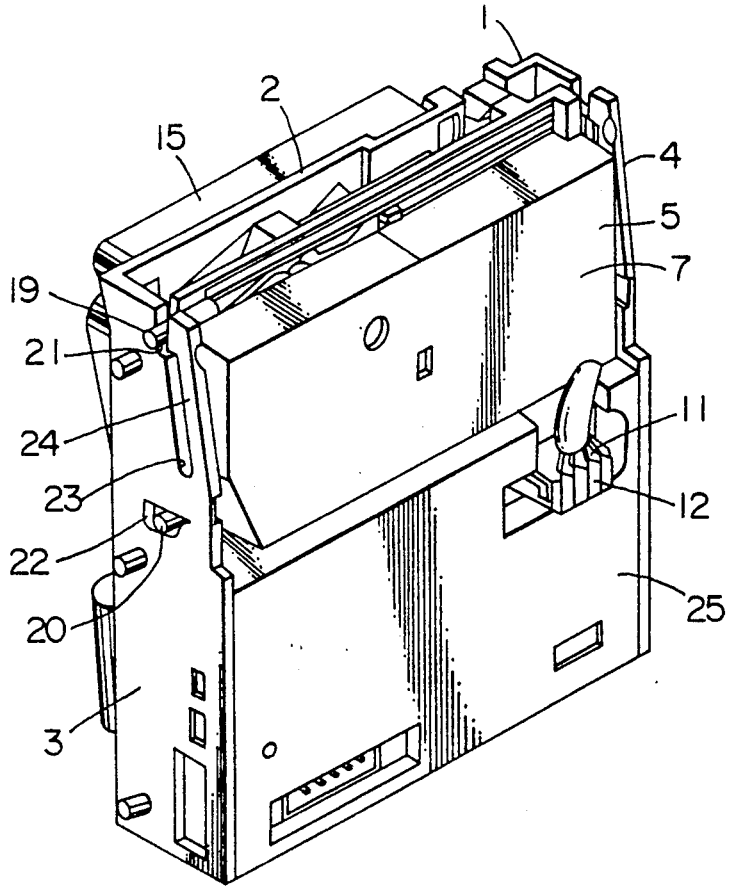
FIG. 1 is a perspective front view of a coin acceptor according to the invention.

Referring to FIG. 1 illustrating an embodiment of an electronic coin acceptor according to the present invention, a common components portion includes a channel shaped plastic casing frame 1 consisting of main frame plate 2 and side plates 3 and 4 extending perpendicularly from the opposite ends of the main frame plate 2. The channel shaped casing frame 1 provides a recess 6 in the upper portion thereof for detachably fitting a particular components portion 5.

The particular components portion 5 includes a casing 7 in which a channel shaped passage frame 8 (FIG. 8) is fixedly arranged to define a coin passage having a width and thickness for passing a coin of particular dimensions and two pair of sensor coils 9 and 10 are arranged in opposite side walls of the coin passage frame 8 for interacting with the coin travelling in the coin passage. A standard oscillating circuit 36 is also fixed to the inner wall of the casing 7. The oscillating circuit 36 is electrically connected to the sensor coils 9 and 10 and has output lead wires 11 (FIG. 3, 4) are led out of the casing 7 and terminate at a connector 12 to output information signals in response to the dimension and material of the coin passing from an inlet 8*a* to an outlet 8*b* of the channel shaped passage frame 8. The coin passage has a movable edge plate 13 (FIG. 8) which is urged to an opening 8*c* of the channel shaped passage frame 8 by means of a spring 14 to usually close the opening 8*c* and is moved away from the opening 8*c* by an actuating lever 15 (FIGS. 1–3) pivoted on the casing frame 1 to open the opening 8*c* of the passage frame 8 and allow ejection of a coin trapped in the coin passage between the edge plate 13 and a stationary edge plate 17 when the actuating lever 15 is pushed downwardly by a rejecting lever (not shown), which is part of the game machine, in the known manner. The movable edge plate 13 is slidably supported on the casing frame 1 and guided in a direction shown by an arrow by means of an engaging pin on the casing frame 1 and a slot 16 on the plate 13.

Figure 3:
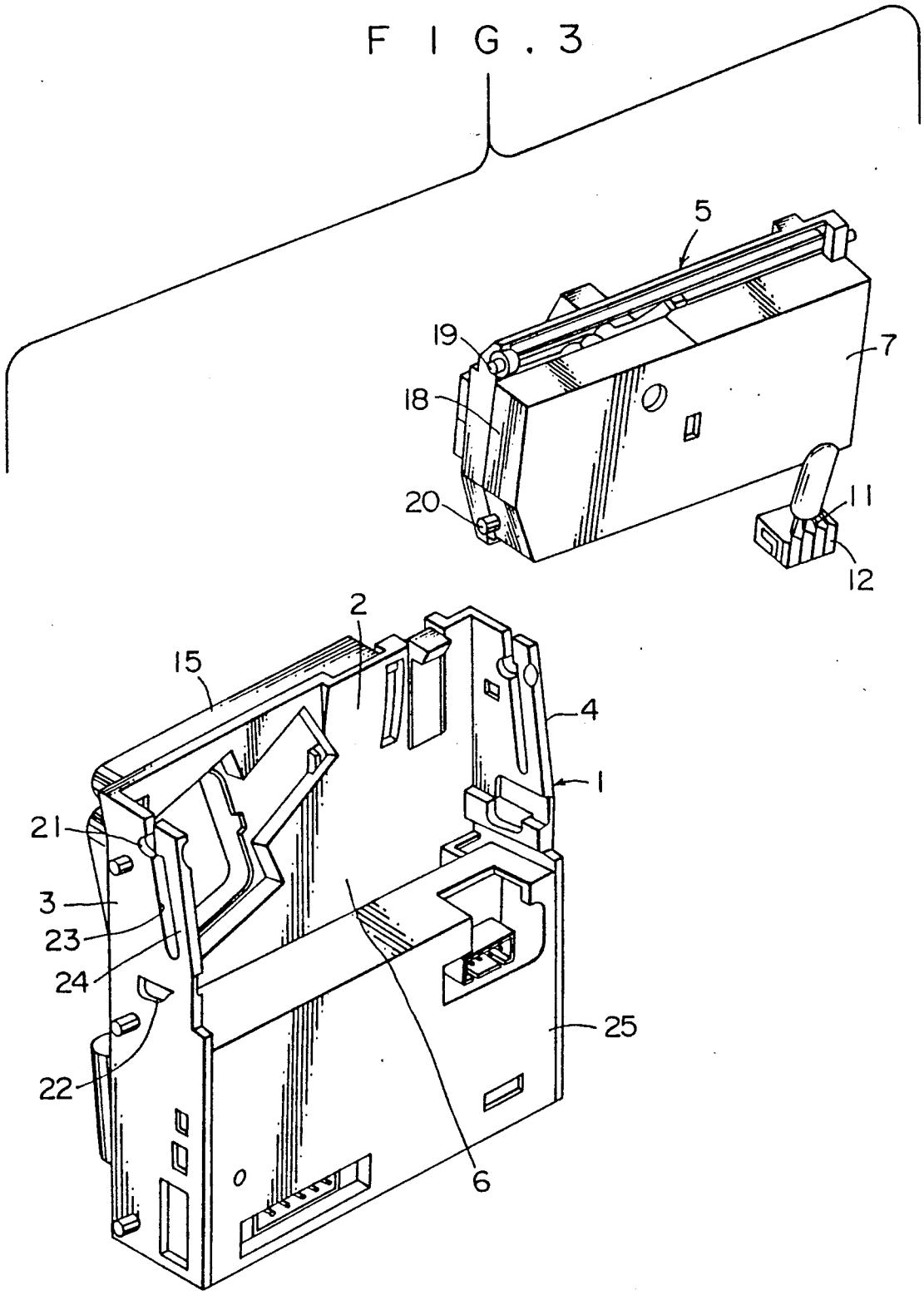
FIG. 3 is a perspective front view similar to FIG. 1 illustrating a particular components portion being detached from a common components portion.

Referring to FIG. 3, the casing 7 enclosing the particular components portion 5 has engaging pins or projections 19, 20 extended from the both side plates 18 at the upper and lower positions. On the other hand, the channel shaped casing frame 1 has engaging slots 21 and 22 formed in the side plates 3 and 4 at the upper and lower positions so as to be engaged with the upper and lower projections 19 and 20, respectively. The side plates 3 and 4 have slits 23 passing through the upper slots 21 and extending in the longitudinal direction of the side plates 3 and 4 to provide long releasing portions 24 which are elastically deformable to open the upper slots 21 for insertion of the upper projections 19 on the casing 7 when the casing 7 is fitted into the upper recess in the channel shaped casing frame 1.

Figure 4:
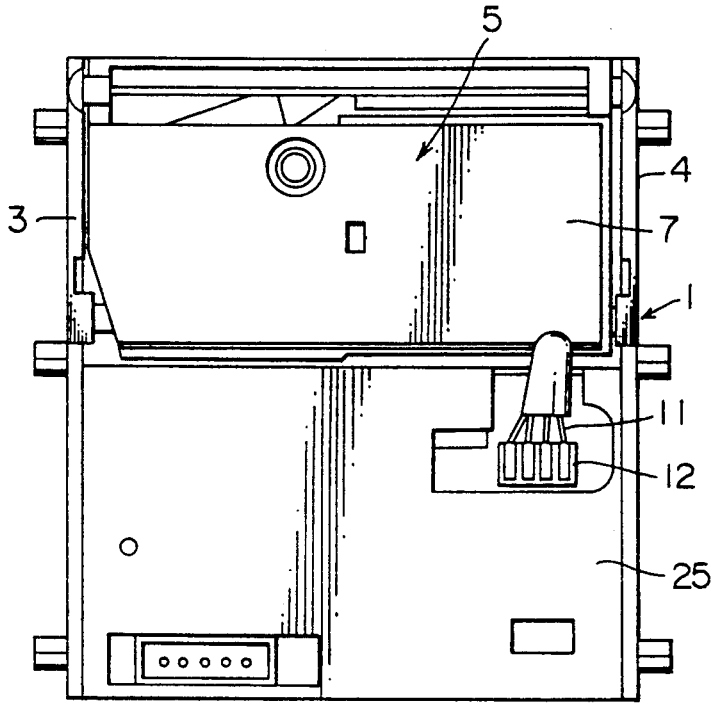
FIG. 4 is a front elevational view of the coin acceptor shown in FIG. 1.
Figure 5:
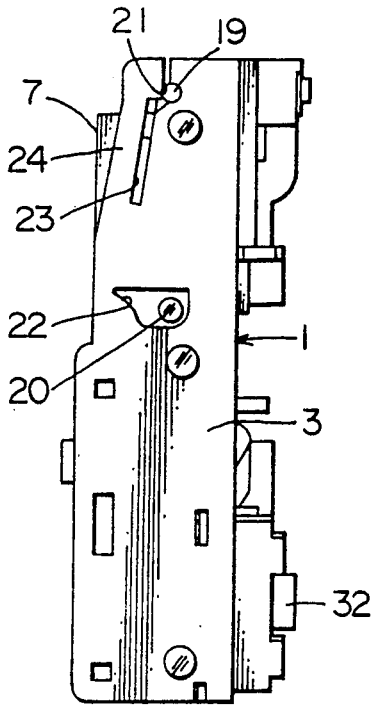
FIG. 5 is a side view of the coin acceptor shown in FIG. 4.
Figure 6:
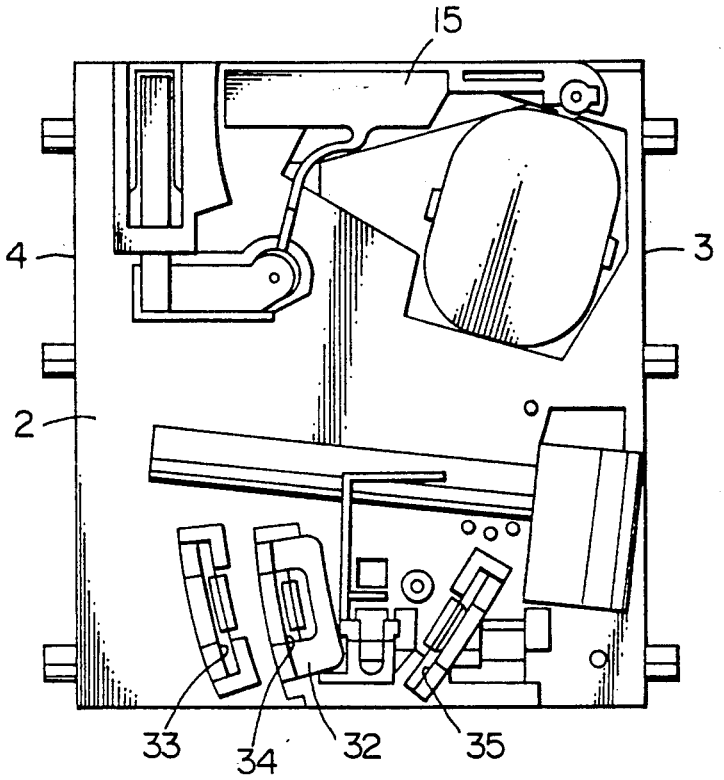
FIG. 6 is a rear view of the coin acceptor shown in FIG. 4.
Figure 7:
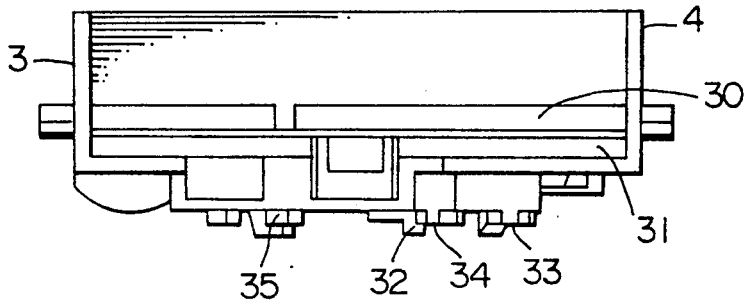
FIG.7 is a bottom view of the coin acceptor shown in FIG. 4.

The channel shaped casing frame 1 is provided with a gate 27 (FIG. 8) extending across the whole width of the inner chamber 26 enclosed by a cover plate 25 (FIG. 4) to be positioned at an inlet of an acceptance chute 31 in the lower portion of the frame 1. The gate 27 is pivoted at opposite end pins 28 on the frame plate 2 and is connected to a movable piece of an electromagnetic solenoid 29. The gate 27 is always opened to a rejection chute 30 (FIG. 7) and is rotated about the pivot pins 28 to change the open position from the rejection chute 30 to the acceptance chute 31 when the electromagnetic solenoid 29 is energized.

The acceptance chute 31 is also extended over the whole width of the inner chamber 26 and positioned parallely to the rejection chute 30. The acceptance chute 31 is provided with an outlet guide plate 32 for guiding the coin to drop toward a coin box (not shown) which is located at a right side or a left side in the coin operated vending machine. Moreover, a coin discriminating circuit 37 for determining whether the information signals from the oscillating circuit 36 of the particular components portion 5 are indicative of an acceptable coin and producing a gate actuating signal is arranged in an inner chamber enclosed by casing 25 of the common components portion.

Figure 2:
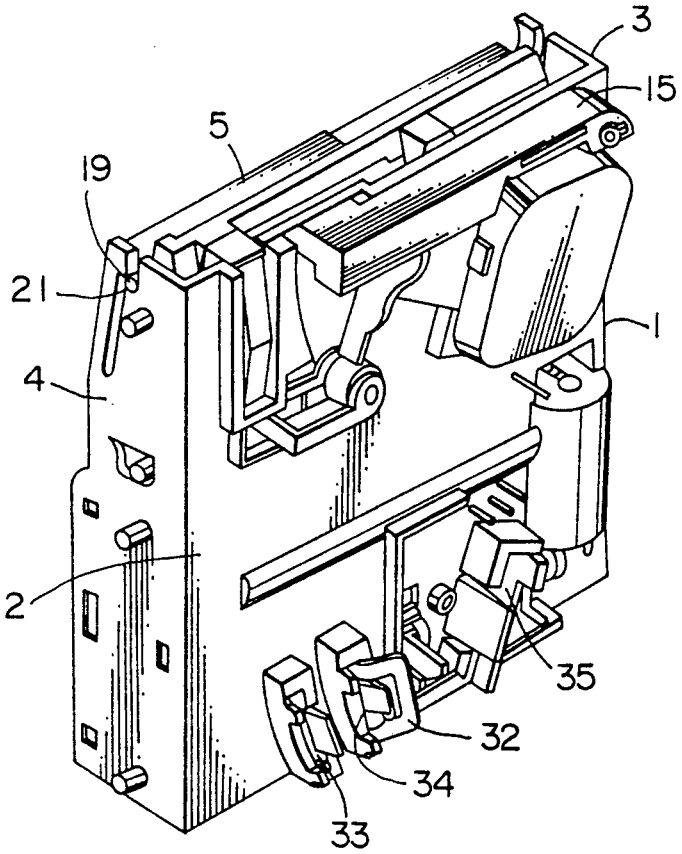
FIG. 2 is a perspective rear view of the coin acceptor shown in FIG. 1.
Figure 8:
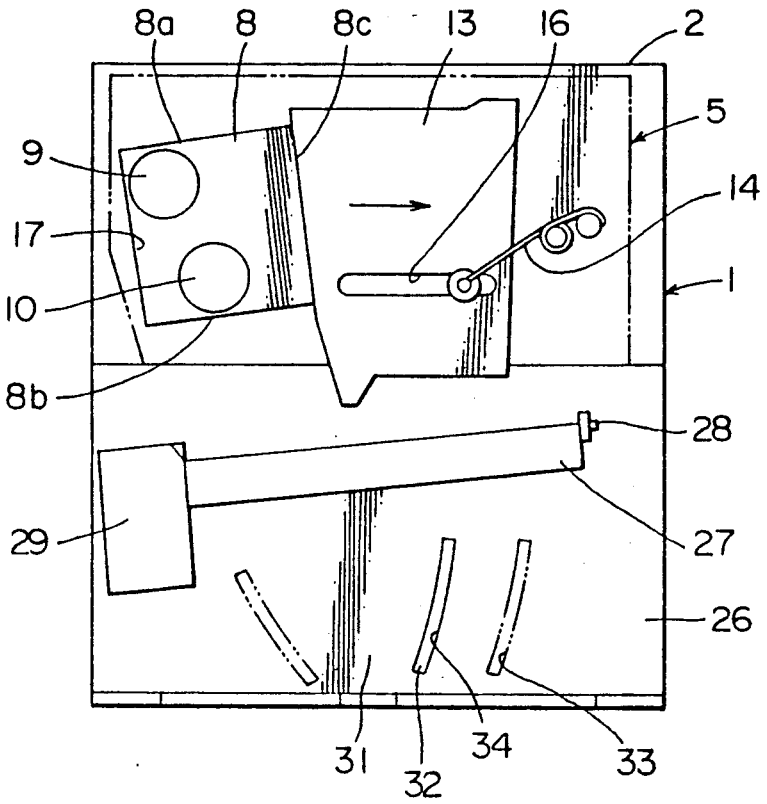
FIG. 8 is a schematic view illustrating the inside of the coin acceptor shown in FIG. 4.
Figure 9:
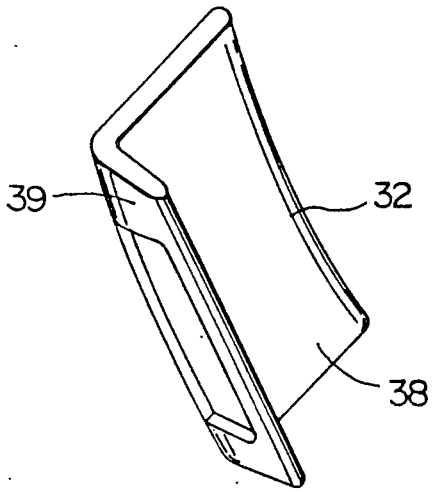
FIG. 9 is a perspective view of an outlet guide plate.

Referring FIG. 8, the guide plate 32 is inserted into one of guide plate setting slots 33, 34 and 35 from the outside as shown in FIG. 2 to extrude in the acceptance chute 31. The guide plate setting slots 33, 34 and 35 are spaced apart in the direction of the width of the acceptance chute 31 such as to selectively position the guide plate 32 to guide the coin into the coin box positioned to the right side or the left side or to effectively guide a small coin such as a five cent coin and a large coin such as a one dollar coin. The guide plate 32 has a curved guide surface 38 and a handle 39 as shown in FIG. 9.

What is claimed is:

1. An electronic coin acceptor comprising a particular components portion including a coin passage having opposite side walls and having a width and thickness for passing a coin of particular dimensions, at least one sensor arranged at at least one of opposite side walls (3, 4) of the coin passage for interacting with a coin travelling in the coin passage, an oscillating circuit electrically connected to the sensor for providing information signals in response to the dimensions and material of the coin and a casing enclosing the particular components, and a common components portion including a coin discriminating circuit for determining whether the information signals are indicative of an acceptable coin and producing a gate actuating signal, a coin acceptance chute, a coin rejection chute, a gate arranged at an inlet of the coin acceptance chute, an electromagnetic solenoid for actuating the gate and an outer frame enclosing the common components and having a particular components portion receiving recess, wherein the acceptance chute is provided with a pluraliity of guide plate setting slots in a side wall and an outlet guide plate which is selectively inserted into one of said plurality of guide plate setting slots from the outside to extend in and define the limits of the acceptance chute whereby the width of the acceptance chute can be adjustably set dependent upon the slot selected.

2. A coin acceptor claimed in claim 1, wherein the casing of the particular components portion is detachable from the particular components portion receiving recess of the outer frame of the common components portion.

3. A coin acceptor claimed in claim 2, wherein the casing is provided at the opposite side walls with engaging upper and lower projections and the recess (6) is defined by a channel shaped plastic casing frame (1) which is provided at the opposite side walls (3, 4) with engaging upper and lower slots (21, 22) and slits (23) extending through the upper slots (21) along the length of the opposite side walls.

4. A coin acceptor claimed in claim 1, wherein the acceptance chute of the common components portion is extended over the width of the outer frame and the gate is extended across over the acceptance chute.

5. A coin acceptor claimed in claim 1, wherein the guide plate setting slots are spaced apart in the direction of width of the acceptance chute.

6. The coin acceptor according to claim 1 wherein said coin acceptance chute includes:

chute side walls having at least two guide plate setting slots therethrough; and an outlet guide plate which is selectively insertable into one of said guide plate setting slots to project into said coin acceptance chute.

7. The coin acceptor according to claim 6 wherein said guide plate setting slots are spaced apart in the direction of the width of said acceptance chute.

8. An electronic coin acceptor comprising a coin passage having opposite sides spaced to pass a coin of particular dimension, at least one sensor mounted at at least one of opposite sides of the coin passage for interacting with a coin travelling through the coin passage during operation, an oscillating circuit electrically connected to the sensor for providing information signals in response to the dimension and material of said coin, coin discriminating circuit to receive and determine whether the said information signals from said oscillating circuit are indicative of an acceptable coin and to produce a gate actuating signal, a coin acceptance chute, a coin rejection chute, a gate arranged at a branch point between an inlet of the coin acceptance chute and an inlet of the coin rejection chute, and an electromagnetic solenoid for actuating the gate, said coin passage, sensor, oscillating circuit being arranged for a particular coin in a particular component casing, and said coin discriminating circuit, coin acceptance chute, coin rejection chute, gate and electromagnetic solenoid being commonly arranged for various kinds of coins in an outer frame which has a recess removably receiving said casing wherein the acceptance chute is provided with a plurality of guide plate setting slots in a side wall and an outlet guide plate which is selectively inserted into one of said plurality of guide plate setting slots to extend in and define the limits of the acceptance chute whereby the width of the acceptance chute can be adjustably set dependent upon the slot selected.

* * * * *